United States Patent [19]

Hyams

[11] 4,366,594

[45] Jan. 4, 1983

[54] LEAF MASTER

[76] Inventor: H. B. Hyams, 24 S. Groveland Ave., Medford, Oreg. 97501

[21] Appl. No.: 248,492

[22] Filed: Mar. 27, 1981

[51] Int. Cl.[3] ..... A47L 5/36

[52] U.S. Cl. ..... 15/314; 15/340; 15/414

[58] Field of Search ..... 15/314, 340, 347, 414; 285/272, 275, 302

[56] References Cited

U.S. PATENT DOCUMENTS

| | | | |
|---|---|---|---|
| 1,944,976 | 1/1934 | Hamilton | 15/314 X |
| 2,772,438 | 12/1956 | Diaz | 15/314 |
| 2,803,847 | 8/1957 | Hobbs | 15/314 |
| 2,951,632 | 9/1960 | Hanson | 15/314 X |
| 3,243,834 | 4/1966 | Trapp | 15/340 |
| 3,594,848 | 7/1971 | Atkinson | 15/340 |
| 3,613,915 | 10/1971 | Vita | 15/340 X |
| 3,619,994 | 11/1971 | Rohde | 56/13.1 |
| 3,665,545 | 5/1972 | Beekman | 15/314 |
| 3,710,412 | 1/1973 | Hollowell | 15/340 |
| 4,017,281 | 4/1977 | Johnstone | 55/334 |

*Primary Examiner*—Chris K. Moore

*Attorney, Agent, or Firm*—Kolisch, Hartwell & Dickinson

[57] ABSTRACT

A vacuum-operated debris collector including a mobile frame and a collection receptacle and impeller unit assembly mounted on the frame. An upstanding stack assembly has its lower end connected through an access chamber to the inlet of the impeller unit. A suction head connects through a hose to a swiveled upper portion of the stack assembly. The outlet of the impeller unit discharges into the receptacle.

10 Claims, 5 Drawing Figures

LEAF MASTER

BACKGROUND AND SUMMARY OF THE INVENTION

This invention relates to debris collectors, and more particularly, to a debris collector which includes an impeller or blower, and utilizes the suction created by the impeller to pick up and collect debris such as leaves, litter, etc.

A number of forms of apparatus of this general description have been proposed in the past. Exemplary of such is the equipment disclosed in U.S. Pat. Nos. 3,243,834; 3,594,848; 3,619,994; 3,710,412; and 4,017,281. The devices illustrated in these patents are subject to a number of disadvantages, in that they offer difficulties in maneuvering in tight locations; they do not provide adequate versatility in operation of any pick-up head employed in actually picking up material; the vacuum generated by the impeller in the device is inefficiently used; many are extremely complicated in construction and, as a consequence, are expensive to produce and have a limited market; and many offer major problems in maintenance and repair.

Generally, an object of this invention is to provide an improved vacuum-operated debris collector which overcomes the problems enumerated above in a highly practical and satisfactory manner.

Another object of the invention is to provide such a vacuum-operated collector which is highly maneuverable, and thus readily utilized in cleaning up areas that, as a practical matter, are essentially unreachable with most prior art devices.

Yet a further object of the invention is to provide such a vacuum-operated collector which includes a novel conduit system connecting with a motor-driven impeller unit in the apparatus, which enables any suction head supplied vacuum by the impeller unit to the conduit system to be positioned at substantially any location about the perimeter of the apparatus.

Specific features of the invention comprise the organization of a collection receptacle and motor-driven impeller unit mounted on a single mobile or wheel-supported frame, and a swivelable conduit section in a conduit system supplying a vacuum to a suction head which may be swiveled without obstruction over a 360° arc to accommodate desired positioning of the suction head; a ring bearing assembly for such swiveled conduit section which is simple in construction and provides essentially unobstructed movement of air through the conduit section into the impeller unit; and a unique boom-like carrier and a mounting therefor, which is utilizable in partially supporting a flexible hose employed in connecting the swiveled conduit section to a suction head.

Other features of the invention which render it compact, flexible in operation, highly maneuverable, and a relatively maintenance free unit will become more fully apparent as the following description is read in conjunction with the accompanying drawings, wherein:

DETAILED DESCRIPTION OF A PREFERRED EMBODIMENT OF THE INVENTION

Figure 1:
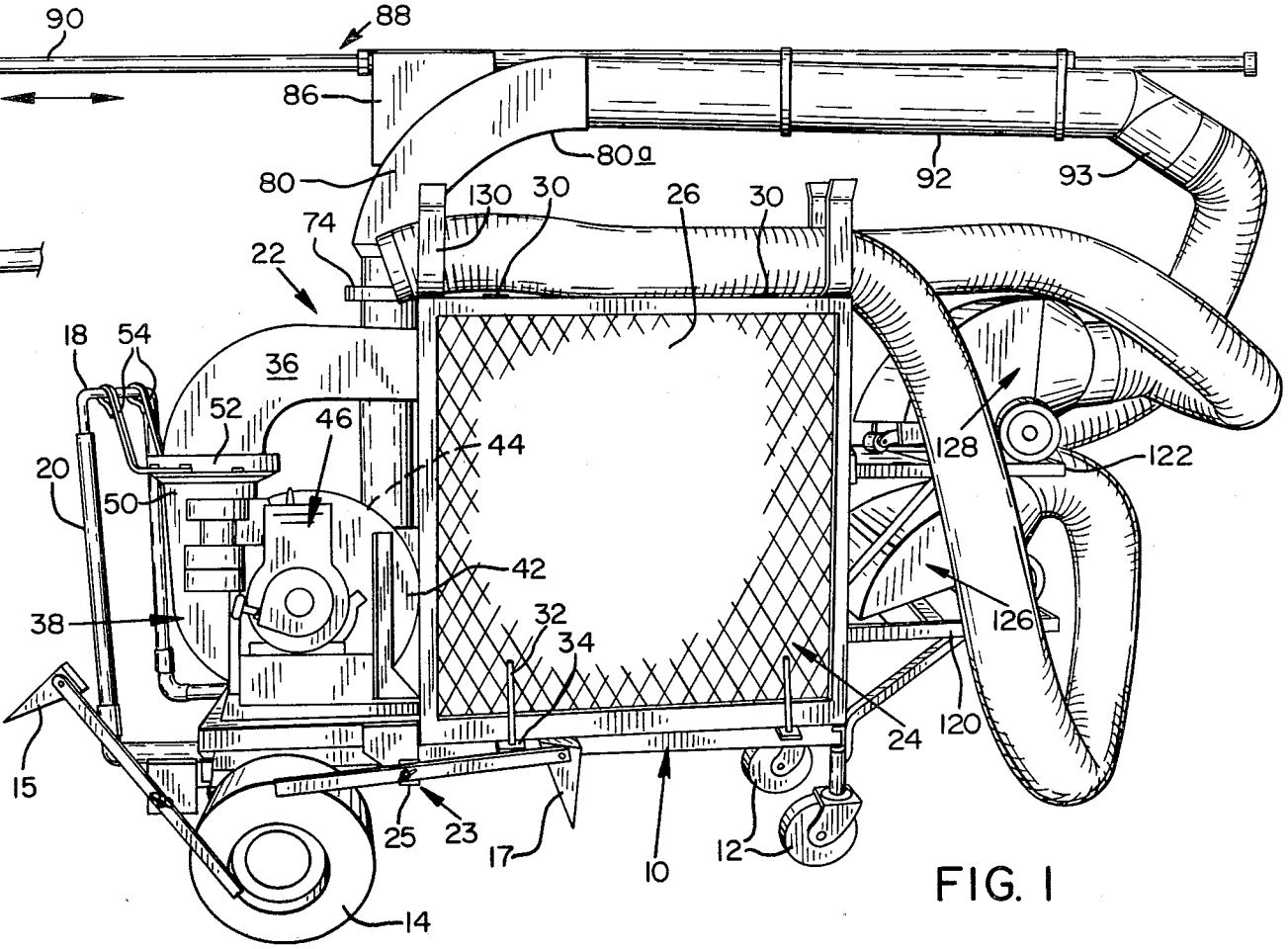
FIG. 1. is a perspective view illustrating, essentially in side elevation, apparatus constructed according to an embodiment of the invention.

Referring now to the drawings, the apparatus illustrated comprises a wheel-supported vehicle frame indicated generally at 10. Supporting one end of the frame, referred to as the front end, are a pair of caster wheels 12. The opposite end or rear end of the frame is supported on wheels 14 mounted on an axle 16. A handle bar 18 carried by posts 20 which are joined to the rear end of the frame is utilized in maneuvering the frame over the ground. The frame is easily pushed or pulled, with the caster wheels accommodating turning of the frame as controlled by the operator.

Figures 2, 4, 5:
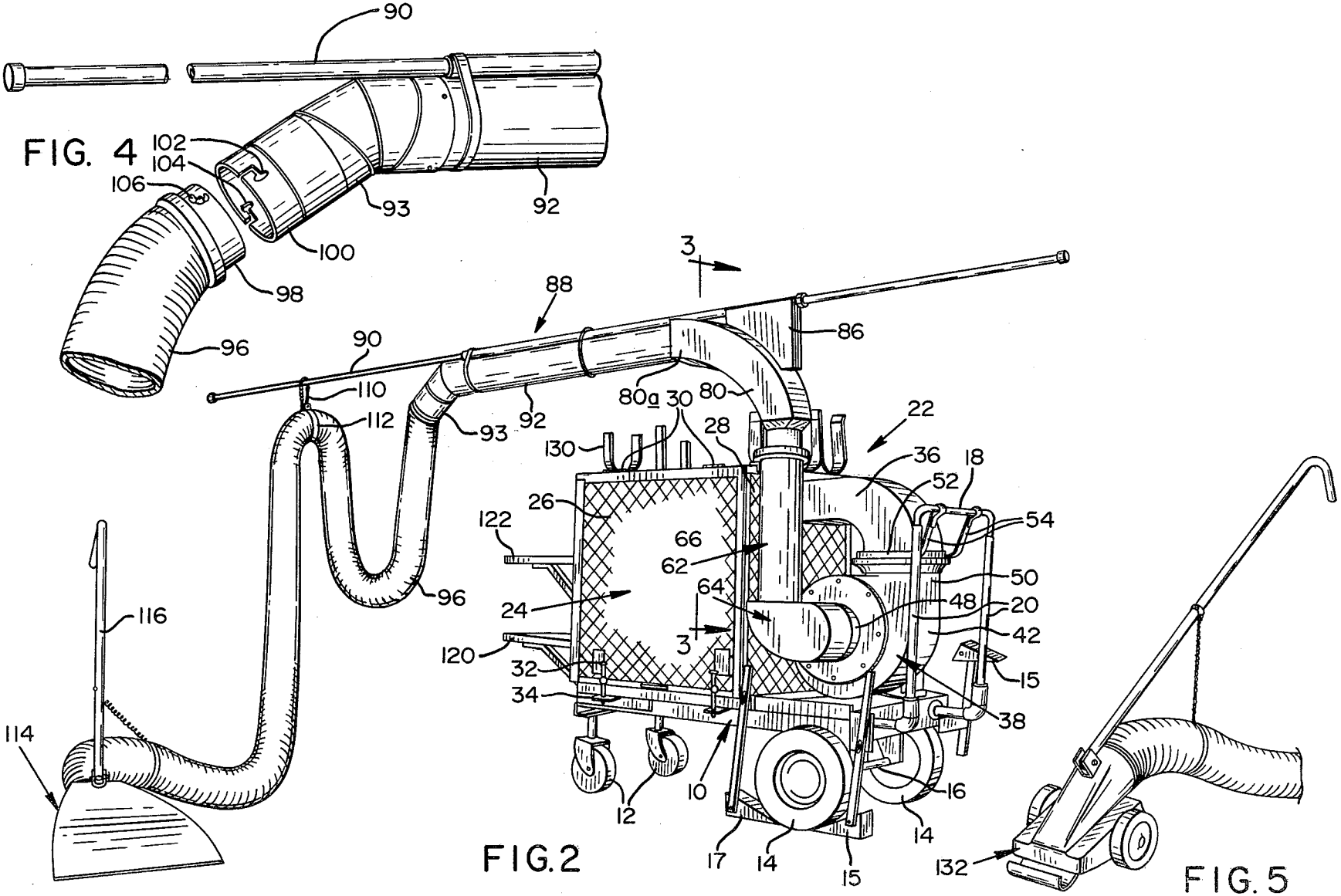
FIG. 2 (second page of drawings) is another perspective view illustrating the opposite side of the apparatus illustrated in FIG. 1, and showing chocks provided in the apparatus breaking movement of the apparatus.
FIG. 4 (second page of drawings) is a perspective view, illustrating coupling means used in coupling a flexible hose to a conduit section.
FIG. 5 illustrates, in a perspective view, a different form of section head which may be employed with the equipment.

Each of the wheels 14 is provided with a pair of chocks shown at 15, 17 mounted on arm 19, 21 which are pivotally supported on the frame of the vehicle by pivot means 23, which pivot means includes a manually operated wing nut 25. The chocks 15, 17 are shown arranged in an inoperative position in FIg. 1, the same arms 19, 21 being secured in this position with tightening of the wing nuts 25. To swing the chocks downwardly to place them against opposite sides of the wheel associated with the chocks, the wing nuts loosened, and the extremities of the arms holding the chocks swung downwardly toward each other, which positions the chocks as shown in FIG. 2.

Mounted on and supported over the frame 10 is a collection receptacle and impeller assembly 22.

Describing more specifically this assembly, debris collected during use of the apparatus is collected in receptacle or cage 24 mounted on the forward end of the frame. The cage illustrated has wire mesh panels, such as the panels shown at 26, 28, forming the bottom, sides and top of the cage. Side panels 26 are hingedly mounted, as by hinges 30, to the top of the cage, and are maintained in a closed position by slide bolts 32, which in their lowered position engage tabs 34. On lifting of the slide bolts associated with each side panel, the side panel may be lifted upwardly with swinging of the panel about its hinged mounting to accommodate dumping of material from the cage. As will later become more fully apparent, material is introduced into the cage through a duct 36. If desired, a bag of suitable size of porous material may be fitted over the extremity of duct 36 where such communications with the cage, with such bag as confined by the cage serving to collect material. Alternatively, the bag may be eliminated and material directly collected in the cage.

Assembly 22 further includes an impeller unit 38 suitably mounted on the rear-end of the frame, directly behind cage 24. The impeller unit includes a convolute housing 42 and a rotatable, centrifugally operating impeller blade device, indicated generally at 44, disposed within the housing and rotated under power as by gasoline motor 46. The impeller unit is positioned so that inlet 48 to the impeller unit, which extends axially of the impeller blade device, has an axis which is disposed horizontally and extends transversely of frame 10. As the impeller unit is positioned, outlet 50 of the unit extends tangentially from the location of the impeller blade device and upwardly from the impeller unit. Duct 36 earlier described, connects the outlet 50 with cage 24 adjacent the top of the cage.

Forming part of the mounting for the impeller unit housing and duct 36 in the apparatus, is a collar 52 which is supported from handle bar 18 by straps 54.

Shown at 62 is a stack assembly. Connecting the base of the stack assembly to inlet 48 of the impeller unit is a housing 64 defining an impeller access chamber.

Figure 3:
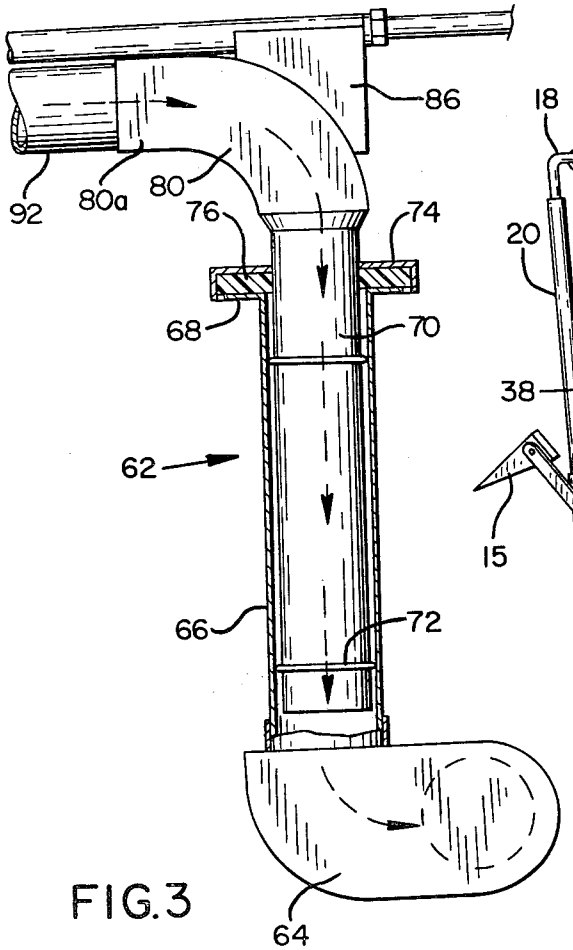
FIG. 3 (first page of drawings) is a side elevation view, partly in cross-section, taken generally along the line 3—3 in FIG. 2, illustrating verticle stack structure in the apparatus.

Referring to FIG. 3, stack assembly 62 comprises an upright outer stack 66 of rigid, for instance metal construction, suitably mounted in a stationary position extending upwardly adjacent the sides of the cage. The base of this outer stack communicates with the interior of housing 64 defining the chamber communicating with the inlet to the impeller unit. Joined to and extending around the upper end of this outer stack is an annular flange 68.

The stack assembly further includes an inner stack 70, telescopically received within the outer stack. Such is positioned in a vertical position by the outer stack, and if desired to produce a snugger fit, beads, such as bead 72, may be provided about the periphery of the inner stack which engage the inside of the outer stack and center the inner stack.

Secured to the upper end of the inner stack, which projects above the upper end of the outer stack, is a retainer 74 including a flange secured to the inner stack and a depending skirt joined to the outer extremity of such flange, such depending skirt overlying the margins of flange 68. Interposed between the retainer and seated within the retainer, with its lower side bearing on flange 68, is an annular bearing member 76. The construction described provides a rotatable mounting for the inner stack, with rotation being about a verticle axis extending axially of the stack assembly. Rotation is accommodated throughout an entire 360° area.

A tubular elbow 80 of a substantially square cross-section, joins with the top of the inner stack. The elbow is made of rigid material, such as metal, and its end **80*a* constitutes part of a horizontally extending conduit section which is capable of swinging throughout a full 360° arc in a plane disposed above the collection receptacle and impeller unit assembly 22**. Thus there is no obstruction offered to such movement by the assembly.

Joined to elbow 80 is an upstanding bracket 86 which mounts an elongate, boom-like hose carrier 88 having an end 90 which is telescopically extensible from the main body of the hose carrier.

A sheet metal conduit section 92 joins with the outer end **80*a* of the elbow, and such terminates in a downwardly inclining segment 93. This downwardly inclining segement is adapted to have detachably connected thereto various lengths of flexible hose, as exemplified by flexible hose 96 shown in FIGS. 2 and 4**.

Specifically, flexible hose 96 terminates in a metal, i.e., stiff annular sleeve 98 which is adapted snugly to fit within a stiff annular sleeve 100 presented at the end of inclining segment 93. Annular sleeve 100 is notched with a pair of opposed L-shaped notches 102, 104. These receive the shanks of fastener assemblies such as fastener assembly 106 including a wing nut. It should be obvious that to complete a connection between the end of the hose and inclining segment 93, the wing nuts are loosened, and sleeve 98 inserted into sleeve 100 with fitting of the shanks of the fastener assemblies within the notches. After which the sleeve 98 is turned. Tightening of the wing nuts complete the connection. The connection provided is essentially fluid-tight, and offers minimal resistance to the flow of air therethrough.

The hose, extending outwardly from its connection with segment 93, may be supported on the hose carrier, as by providing loop 110 which slides on the hose carrier and is connected to the hose by band 112.

The end of the hose may be provided with a suction head unit such as the one shown at 114. Such is guided by handle 116 for movement over the ground. Suction introduced into the hose by operation of the impeller unit is confined over a region of the ground by the suction head unit, so that debris covered by the unit tends to be withdrawn into the unit and thence travel upwardly into the hose.

As best seen in Fig. 1, at 120, 122 are shelves secured to the frame of the apparatus adjacent the end opposite the end mounting the impeller unit. These may be utilized in supporting different sizes of suction head units, as exemplified by those shown at 126, 128 in FIG. 1. Since the suction head units are shown with flexible hoses connected to each, the apparatus further includes, on the top of the cage, U-shaped brackets 130 into which lengths of the flexible hose may be fitted.

The provision of different sizes of suction head units is advantageous in providing maximum maneuverability, and flexibility in meeting the needs of a particular chore. For instance, the larger size of suction head unit illustrated in FIG. 2, is appropriate for clearing up debris from lawns and wider expanses. A smaller suction head unit might be used for flower or vegetable gardens, where there are space limitations because of the spacing utilized between various plantings. A relatively small suction head, such as that illustrated in FIG. 5 at 132, would provide a relatively concentrated vacuum for use in hard to clear places, where space limitations are severe.

The apparatus described is completely self-contained and requires no tractors, trailers or additional equipment such as carts, racks, etc. The provision of multiple suction heads which are quickly attached to conduit section 92 through the coupling means described, provides maximum versatility. The provision of the boom or hose carrier for supporting the flexible hose which is swivelable about a full 360° arc permits the suction head unit which is connected to the hose to be moved anywhere about the apparatus. All structure supported for swiveling movement derives its support from the bearing and inner and outer stacks described. Housing 64 provides an access chamber which permits unencumbered movement of air into the impeller unit. Material discharged into the cage is readily removed through opening of the hinged side panels in the cage.

While a particular form of the invention has been illustrated in the drawings and described above, it should be obvious that modifications and variations are possible without departing from the invention.

It is claimed and desired to secure by Letters Patent:

1. A vacuum-operated debris collector comprising:

a wheel-supported vehicle frame, a collection receptacle and impeller unit assembly mounted on said frame including a collection receptacle supported over said frame adjacent one end of the frame, and a motor-driven impeller unit supported over said frame adjacent the opposite end of the frame, said impeller unit having an outlet for pressurized air and an inlet for air at sub-atmospheric pressure and said inlet and outlet being located below the level of the top of said assembly, conduit means connecting said outlet and said collection receptacle, a rigid upright conduit assembly connected at its lower end to said inlet and having an upper extremity located above the top of said collection receptacle and impeller unit assembly, a rigid outwardly extending conduit section connected at its inner end to said upper extremity of the upright conduit assembly, said upright conduit assembly including swivel means accommodating swiveling of the outwardly extending conduit section about the axis of the upright conduit assembly over 360° to place the outwardly extending conduit section at any desired laterally extending direction, a suction head, a hose connected at one end to the suction head, and detachable coupling means connecting the opposite end of the hose to said outwardly extending conduit section, said coupling means including stiff inner and outer sleeves constructed and arranged with the inner sleeve snugly nested within the outer sleeve, said coupling means further including manually operated means detachably locking the sleeves from relative axial displacement, one sleeve being joined in fluid-tight relation to said opposite end of the hose and the other sleeve being joined in fluid-tight relation to the outer end of the outwardly extending conduit section.

2. The collector of claim 1, which further includes an elongate rigid hose carrier mounted on said outwardly extending conduit section and deriving its support from said conduit section, and wherein said hose intermediate its end is dependently supported from said hose carrier.

3. A vacuum-operated debris collector comprising:

a wheel-supported vehicle frame, a collection receptacle mounted on said frame adjacent one end of the frame, a motor-driven impeller unit mounted on said frame adjacent the opposite end of the frame, said impeller unit having a centrifugally operating rotatable impeller device, a suction inlet extending axially of the impeller device with the axis of aid inlet disposed horizontally and extending transversely of the frame, and a tangentially extending outlet extending upwardly from the impeller unit, a duct connecting the outlet of the impeller unit and an upper portion of said receptacle, an elongate rigid outer stack stationarily mounted in the collector and a housing connecting the base of the outer stack to said inlet, an inner stack nested within the outer stack having an upper end extending above the upper end of the outer stack, an annular flange extending about and joined to the upper end of said outer stack, means including a bearing interposed between the inner stack and said flange, rotatably supporting the inner stack on the outer stack, a horizontally extending conduit section connected at one end to the upper end of said inner stack and a suction head operatively connected to the other end of the said horizontally extending conduit section.

4. The collector of claim 3, which further includes an elongate substantially horizontal and rigid hose carrier mounted on said horizontally extending conduit section, a flexible hose connects said suction head to said horizontally extending conduit section, said hose intermediate its end being dependently supported from said hose carrier.

5. The collector of claim 4, wherein the horizontally extending conduit section is located at an elevation disposed above the top of said collecting receptacle.

6. The collector of claim 4, wherein said flexible hose is connected to said horizontally extending conduit section through a coupling means including stiff inner and outer annular sleeves constructed and arranged with the inner sleeves snugly nested within the outer sleeve, said coupling means further including manually operated means locking the sleeves from relative axial displacement, one sleeve being joined in fluid-tight relation to the end of the flexible hose and the other sleeve being joined in fluid-tight relation to the end of the outwardly extending conduit section.

7. A vacuum-operated debris collector comprising:

a wheel supported vehicle frame, a motor driven impeller unit supported on said frame, said impeller unit having a centrifugally operating rotatable impeller device, a suction inlet extending axially of the impeller unit with the axis of said inlet horizontally disposed, and a tangentially extending outlet, an elongate outer rigid stack stationarily mounted in an upright position on said frame and a housing connecting the base of the stack to said inlet, an inner stack telescopically received within the outer stack having an upper end extending above the upper end of the outer stack, an annular flange extending about and joined to the upper end of said outer stack, means including a bearing rotatably interposed between the inner stack and said flange rotatably supporting the inner stack on the outer stack, an elbow including a pair of legs having one leg connected to the upper end of said inner stack and the other leg extending horizontally from said one leg, and a suction head operatively connected to the horizontally extending leg of said elbow.

8. The collector of claim 7, wherein such suction head is connected to said horizontally extending leg of said elbow through a flexible hose, said hose having one end connected to said suction head and its opposite end connected to an end of said horizontally extending leg.

9. The collector of claim 8, wherein said opposite end of said hose is connected to said end of said leg through a coupling means including stiff inner and outer annular sleeves constructed and arranged with the inner sleeve snugly nested within the outer sleeve, said coupling means further including manually operated means locking the sleeves from relative axial displacement, one sleeve being joined in fluid tight relation to the end of the leg.

10. The collector of claim 6, wherein the means for rotatably supporting the inner stack on the outer stack further includes an annular retainer secured to the upper end of the inner stack disposed about said flange, and said bearing has a lower portion thereof resting on said flange and the upper portion thereof nested within said retainer.

* * * * *